US008230633B1

(12) United States Patent
Sisk

(10) Patent No.: US 8,230,633 B1
(45) Date of Patent: Jul. 31, 2012

(54) MULTIPLE RIFLE RECOIL LUGS

(76) Inventor: Charles H. Sisk, Dayton, TX (US)

( * ) Notice: Subject to any disclaimer, the term of this patent is extended or adjusted under 35 U.S.C. 154(b) by 229 days.

(21) Appl. No.: 12/803,425

(22) Filed: Jun. 28, 2010

(51) Int. Cl.
*F41A 21/00* (2006.01)

(52) U.S. Cl. ..... 42/75.01; 42/75.02; 42/75.03

(58) Field of Classification Search ..... 42/75.01–75.03
See application file for complete search history.

(56) References Cited

U.S. PATENT DOCUMENTS

| | | | | |
|---|---|---|---|---|
| 1,166,910 | A | 1/1916 | Johnson | |
| 1,234,783 | A | 7/1917 | Mauser | |
| 1,628,798 | A | 5/1927 | Nelson | |
| 2,587,937 | A | 3/1953 | Waltke, Jr. | |
| 3,584,533 | A * | 6/1971 | Allyn | 89/144 |
| 3,653,140 | A | 4/1972 | Alday | |
| 3,711,983 | A * | 1/1973 | Allyn | 42/75.03 |
| 4,547,988 | A * | 10/1985 | Nilsson | 42/16 |
| 4,791,748 | A * | 12/1988 | Leskinen | 42/75.02 |
| 5,123,194 | A * | 6/1992 | Mason | 42/75.02 |
| 5,410,834 | A * | 5/1995 | Benton et al. | 42/75.02 |
| 5,454,182 | A * | 10/1995 | Lewis et al. | 42/51 |
| 6,487,805 | B1 * | 12/2002 | Reynolds | 42/75.03 |
| 6,637,142 | B1 * | 10/2003 | Reynolds | 42/75.03 |
| 6,889,462 | B1 * | 5/2005 | Carlson | 42/75.01 |
| 7,451,564 | B2 * | 11/2008 | Wait | 42/75.02 |
| 8,079,169 | B2 * | 12/2011 | Gregg | 42/75.03 |

* cited by examiner

*Primary Examiner* — Michael Carone
*Assistant Examiner* — Samir Abdosh
(74) *Attorney, Agent, or Firm* — Gordon K. Anderson

(57) ABSTRACT

A set of multiple recoil lugs for a rifle is taught, consisting of a rifle barrel with receiver end and a muzzle end. The receiver end of the barrel having a cartridge chamber therein and receiver threads with an extended chamber portion over the cartridge chamber and at least one set of forward lug attaching threads located between the receiver end and the muzzle end. A threaded receiver recoil lug jointly engages a rifle receiver on the receiver threads which forms a recoil absorbing surface with a rifle stock. One or more forward recoil lugs are mated with the forward lug attaching threads, forming additional recoil absorbing surfaces with the rifle stock. A barrel lock nut is attached to each set of forward lug attaching threads engaging each forward recoil lug, firmly locking each forward recoil lug securely in place. An alternate embodiment is used when the rifle receiver incorporates an integral recoil lug thereby eliminating the necessity of the receiver recoil lug.

6 Claims, 3 Drawing Sheets

MULTIPLE RIFLE RECOIL LUGS

TECHNICAL FIELD

The present invention relates to recoil lugs for rifles in general. More specifically to multiple recoil lugs consisting of a receiver lug and one or more forward recoil lugs for extending the recoil absorbing surface with the rifle stock on large bore big game hunting rifles.

BACKGROUND OF THE INVENTION

Previously, many types of recoil lugs have been used in endeavoring to provide an effective means to absorb the reward force of the rifles recoil without damaging the stock.

The prior art listed below did not disclose patents that possess any of the novelty of the instant invention; however the following U.S. patents are considered related:

| U.S. Pat. No. | Inventor | Issue Date |
|---|---|---|
| 1,166,910 | Johnson | Jan. 4, 1916 |
| 1,234,783 | Mauser | Jul. 31, 1917 |
| 1,628,798 | Nelson | May 7, 1927 |
| 2,587,937 | Waltke Jr. | Mar. 4, 1952 |
| 3,653,140 | Alday | Apr. 4, 1972 |
| 4,791,748 | Leskinen | Dec. 20, 1988 |

Johnson in U.S. Pat. No. 1,166,910 teaches the provisions to provide simple and reliable means for holding the forestock against forward longitudinal displacement without imposing any strain upon the barrel of the gun. The forestock is formed with a longitudinal bore extending throughout its length with a threaded rod entering a threaded opening in an extension attached to the receiver.

U.S. Pat. No. 1,234,783 issued to Mauser is for a dividing piece which is screwed into the receiver and is provided with an internal thread at its front end which receives the rear end of the barrel. The dividing piece incorporates the chamber for the cartridge.

Nelson in U.S. Pat. No. 1,628,798 discloses a barrel secured to the front end of the frame with a breech-bolt mounted to slide and rotate in the frame. A recoil transmitting member comprises a transverse plate portion conforming to the contour of the gun lying laterally across the end surface of the stock. An integral bushing is formed at right angles to the plate and screws onto the frame of body so as to form a joint between the plate and front frame body providing sufficient strength to transmit the recoil shocks the frame body.

U.S. Pat. No. 3,653,140 issued to Alday is for a receiver mechanism for a firearm which provides proper engagement of the locking lugs of the bolt with the locking abutments of the receiver. A roller-type pin acts as a detent to keep the bolt fully extended from the carrier when the bolt is open. On the return of the carrier to the closed position the bolt is allowed to close fully before starting to rotate, thus insuring close engagement between the lugs and the locking abutments.

Leskinen in U.S. Pat. No. 4,791,748 relates to a receiver and recoil lug a gun. The receiver and recoil lug are fastened to the stock and are separate pieces. The recoil lug is fastened to the receiver with a forced fit with guiding surfaces for the gun barrel formed into the receiver and onto the recoil lug. An annular inner surface of the lug is connected with the receiver completing the force fit.

For background purposes and as indicative of the art to which the invention is related reference may be made to the remaining cited patent issued to Waltke Jr. in U.S. Pat. No. 2,587,937.

BRIEF SUMMARY OF THE INVENTION

Historically there has been a problem with large caliber conventional single barrel bolt action dangerous game hunting rifles as the larger the bore and the heavier the bullet more rearward recoil thrust is created placing stress on the stock particularly in wood stocks and even in the newer polymer stocks. Previously only a single recoil lug has been used which places the entire recoil force vectors in a small area between the recoil lug and the magazine on bolt action rifles. On large caliber rifles with wooden stocks a cross bolt has been added in this area for reinforcement however it may be unsightly to some, detracting the symmetry of design and the figure in the wood stock. While this cross bolt reinforcement has some beneficial effect it does not entirely solve the problem as it has still been known to allow compression fractures in the wood with catastrophic results. Even on the later synthetic stocks they still have this problem when using African hunting rifles in calibers such as the 0.375 Holland & Holland Magnum and larger such as the 416 Remington and Weatherby Magnum, 458 Winchester magnum, 458 Lott and the English cartridges, 404/416 Jeffery, 416 Rigby and the 450/400 Nitro Express, etc.

It is therefore the primary object of the invention to add one or more recoil lugs forward of the lug in the conventional receiver location in either wood or synthetic stocks. By this novel lug addition, the recoil is absorbed in the stock in at least two separate locations with the second location distinctly forward of the receiver lug were a significantly substantial mass is available.

An important object of the invention is found in its flexibility as it may be used on rifle actions having a separate recoil lug such as a Remington 700, a Savage 110 and some specialty receivers. The invention may also be employed an action having an integral recoil lug within the receiver itself, such as found on a Sako 75, a Weatherby Mark V, a Ruger MK II or model 77, a Mauser 98, a Winchester 70 and some custom receivers. As an example, using a Remington 700 and the like, the existing unthreaded recoil lug may be replaced with the inventions threaded receiver recoil lug which is secured into the receiver sturdily and has other advantages which are described below.

Another object of the invention is that the use of multiple lugs distributes the energy displacement by at least half on each lug. If desired is possible to add additional forward recoil lugs on the rifle barrel well in front of the first, each distributing the recoil energy to less than its total force. For actions having an integral recoil lug one or more forward lugs may be used to achieve the same result.

Still another object of the invention it that the receiver lug and forward lugs each incorporate at least one supplementary mounting hole on an upper surface which may be used for attaching sights or other like purposes. A tapped bore is included on the bottom of each lug which may be used for attaching ancillary accessories, such as a swing sling swivel, a detachable swivel, a flush mount swivel, a bipod, a forend rail that permits attachment of a flashlight or laser. The extra tapped bore on the bottom of the stock is a valuable feature as it is not obvious as only a small opening is visible, and the user may be able to attach a variety of items without the necessity of gunsmithing.

Yet another object of the invention in the fact that the recoil lug configuration may match the barrel exactly or at least conform to its shape which may be octagonal, fluted or having a round outside diameter, not detracting from the appearance of the rifle barrel.

A further object of the invention is that the use of threads on the barrel affords a positive attachment and alignment for the recoil lugs and locknuts.

A final object of the invention is the ease of forming threads on the barrel to attach the lugs by the original rifle manufacturer, a specialty fabricator or a gunsmith replacing a barrel, since the barrel must already be placed within the jaws of a machine tool lathe for finishing before the barrel is attached to the receiver.

These and other objects and advantages of the present invention will become apparent from the subsequent detailed description of the preferred embodiment and the appended claims taken in conjunction with the accompanying drawings.

DETAILED DESCRIPTION OF THE INVENTION

The best mode for carrying out the invention is presented in terms of a preferred embodiment and an alternate embodiment. The preferred embodiment is employed when the rifle receiver has a removable recoil lug and the alternate embodiment is used when the rifle receiver has an integral recoil lug.

Figure 1:
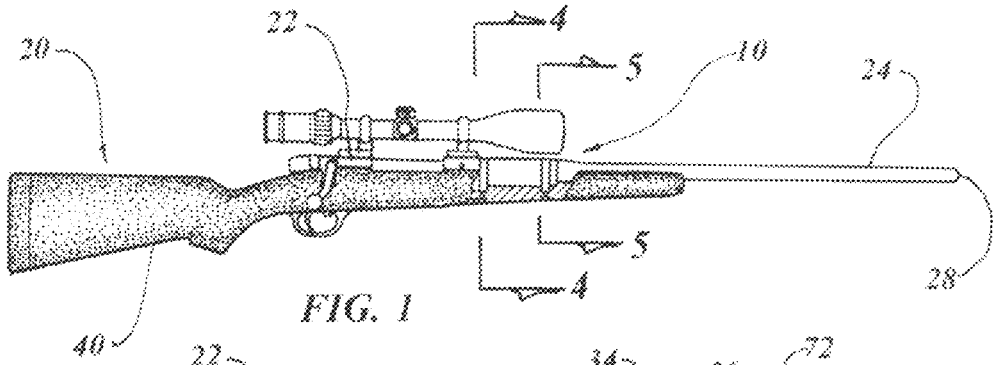
FIG. 1 is a partial isometric cut away view of a typical large bore hunting rifle having dual recoil lugs in the preferred embodiment.
Figure 2:
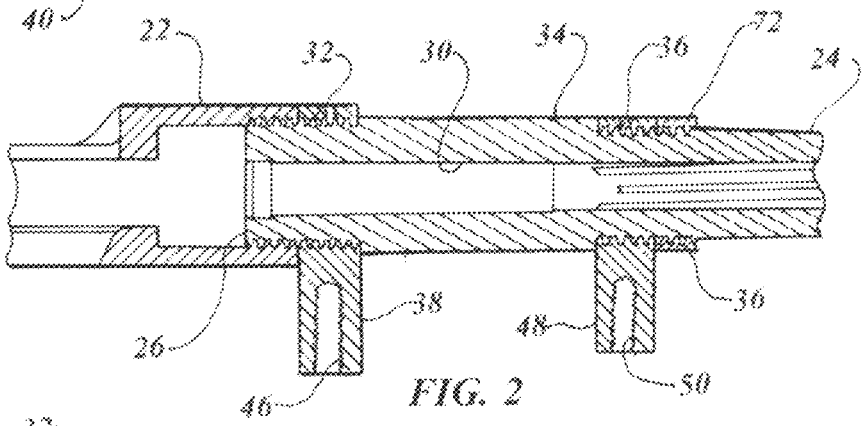
FIG. 2 is a partial cross sectional view taken along an imaginary centerline of a typical large bore hunting rifle with a threaded receiver recoil lug installed adjacent to the receiver and a threaded forward recoil lug installed at the distal end of the barrel extended chamber portion of the preferred embodiment.
Figure 11:
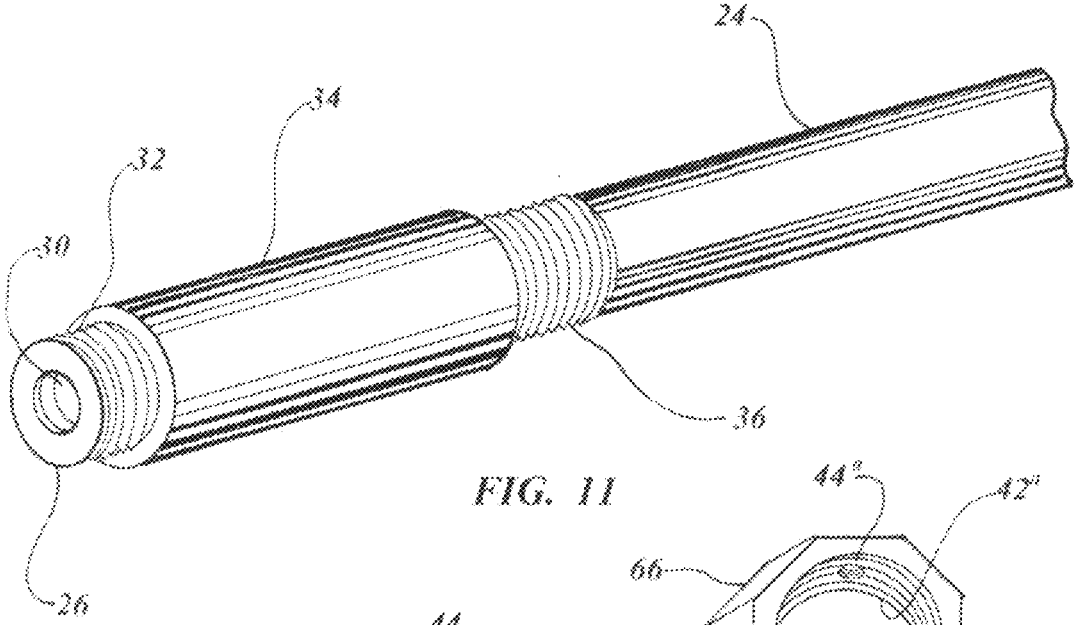
FIG. 11 is a partial isometric view of a typical rifle barrel illustrating forward lug attaching threads utilized in either embodiment.
Figure 12:
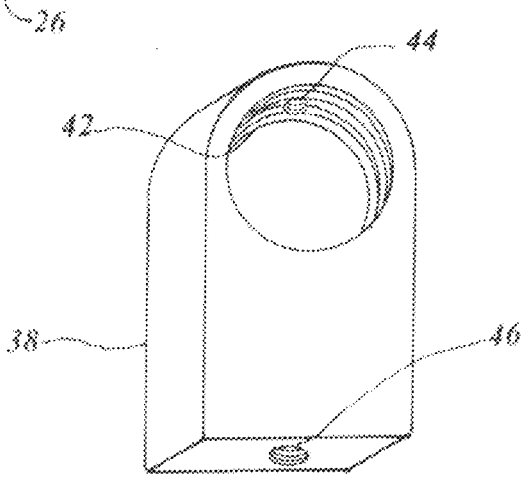
FIG. 12 is a partial isometric view of a receiver recoil lug in the preferred embodiment completely removed from the invention for clarity.

The preferred embodiment is shown in FIGS. 1 thorough 5 and 11 through 16 and is comprised of multiple recoil lugs 10 for a rifle 20 having a receiver 22 with a removable recoil lug. The rifle 20 includes a rifle barrel 24 having a receiver end 26 and a muzzle end 28, with the receiver end 26 having a cartridge chamber 30 therein and a set of receiver threads 32. The barrel 24 has an extended chamber portion 34 above the cartridge chamber 30 and at least one set of forward lug attaching threads 36 located between the receiver end 26 and the muzzle end 28, as illustrated in FIGS. 1 and 11 and partially in FIGS. 2 and 3.

The receiver threads 32 on the barrel 24 have a configuration capable of mating with a specific rifle receiver 22 such that the barrel 24 may be attached to the existing rifle receiver threads 32. The rifle barrel extended chamber portion 34 preferably has a diameter no larger than the specific receiver diameter and a length of from 2.50 to 4.00 inches from this receiver 22.

Figure 3:
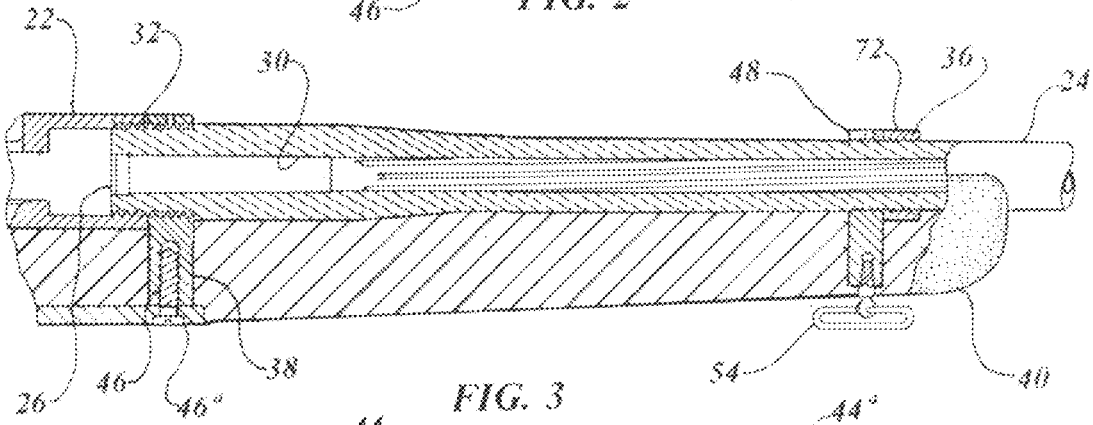
FIG. 3 is a partial cross sectional view taken along an imaginary centerline of a typical large bore hunting rifle with a threaded receiver recoil lug installed adjacent to the receiver and a threaded forward recoil lug installed at least one inch from the rifle stock forend, in the preferred embodiment.
Figure 4:
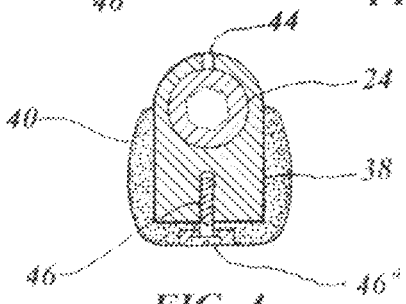
FIG. 4 is a cross sectional view taken along lines 4-4 of FIG. 1 illustrating the receiver recoil lug in the preferred embodiment.
Figure 5:
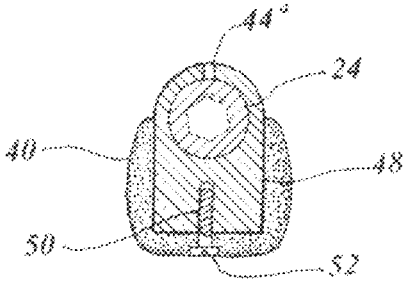
FIG. 5 is a cross sectional view taken along lines 5-5 of FIG. 1 illustrating the forward recoil lug in the preferred embodiment.

A receiver recoil lug, furnished by the original manufacturer of the receiver, is replaced with a threaded receiver recoil lug 38, shown in FIGS. 1-4 and 12, which jointly engages the rifle receiver 22 and the set of receiver threads 32. The receiver recoil lug 38 forms a recoil absorbing surface with a rifle stock 40, as shown in FIG. 3. The receiver recoil lug 38 incorporates a threaded hole 42 that is configured to mate with the specific receiver threads 32 which is differs from the original manufacturer's recoil lug, which has only a round hole therein.

The receiver recoil lug 38 includes a supplementary mounting hole 44 on a top surface for attachment of sights, or other ancillary items, with the mounting hole 44 threaded with the thread characteristic from a #8-40 thread size to a #10-32 thread size. The receiver recoil lug 38 also has a tapped hole 46 on a bottom surface sized from a #¼-28 thread size to a ⅜-24 thread size, or the like, for attachment of a conventional recoil lug screw 46$^{a}$.

One or more threaded forward recoil lugs 48 are mated with the set of forward lug attaching threads 36 with each forward recoil lug 48 forming a forward recoil absorbing surface with the rifle stock 40, as depicted in FIGS. 1-3 and 5. Each forward recoil lug 48 includes a threaded hole 42$^{a}$ configured to mate with each set of forward lug attaching threads 36. While any number of forward recoil lugs 48 may be used they are preferably positioned on the barrel 24 no closer than 1.00 inch from a rifle stock 40 forend, as illustrated in FIG. 3.

The forward recoil lugs 48 each include at least one supplementary mounting hole 44[a] on a top surface for attachment of sights or other ancillary items, with the mounting hole 44[a] threaded having the thread characteristic from a #8-40 thread size to a #10-32 thread size. The forward recoil lug 48 also has a tapped bore 50 on a bottom surface sized from a #10-32 thread size to a ⅜-24 thread size, or the like. Each bore 50 may be used for attachment a of forward recoil lug screw 52, depicted in FIG. 5, or ancillary accessories, including a swing sling swivel 54, shown in FIG. 3, a detachable flush mount swivel 56, illustrated in FIG. 6, a bipod 58, depicted in FIG. 10, or a forend rail 60 permitting attachment of a flashlight 62 or laser 64 etc., shown in FIG. 8.

Figure 9:
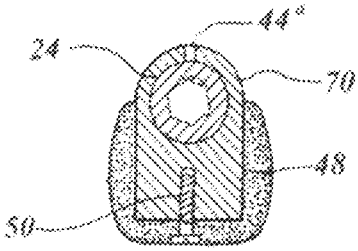
FIG. 9 is a cross sectional view taken along lines 9-9 of FIG. 6 illustrating a first forward recoil lug in the alternate embodiment.
Figure 10:
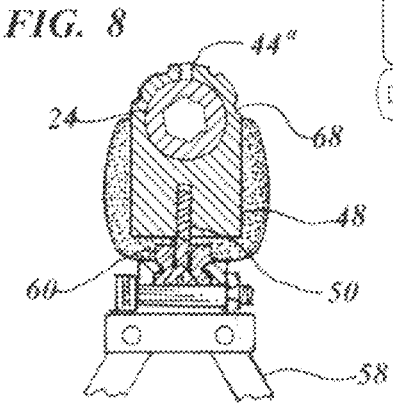
FIG. 10 is a cross sectional view taken along lines 10-10 of FIG. 6 illustrating the second forward recoil lug in the alternate embodiment, with a bipod attached to a rail.
Figure 13:
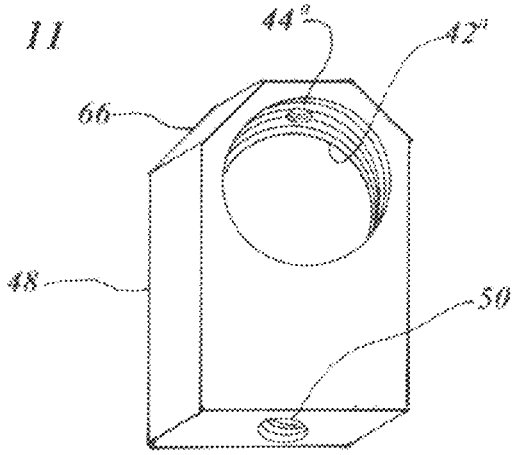
FIG. 13 is a partial isometric view of a forward recoil lug in an octagonal configuration, in both embodiments completely removed from the invention for clarity.

The exposed surface of the forward recoil lug 48 above the stock 40 preferably has an exterior shape that matches the barrel 24 configuration, which includes an octagonal shape 66, illustrated in FIG. 13, a fluted shape 68 shown in FIG. 10, and a round outside radius 70, depicted in FIG. 9.

Figure 14:
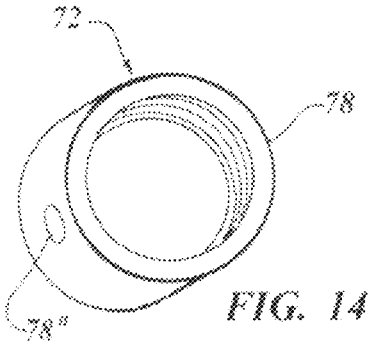
FIG. 14 is a partial isometric view of a barrel lock nut in a round exterior shape with a gripping hole configured to receive a spanner configuration, in both embodiments completely removed from the invention for clarity.
Figure 15:
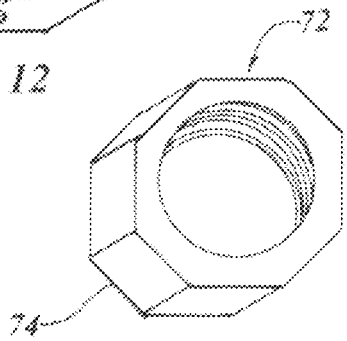
FIG. 15 is a partial isometric view of a forward recoil lug in an octagonal shape configuration in both embodiments, completely removed from the invention for clarity.
Figure 16:
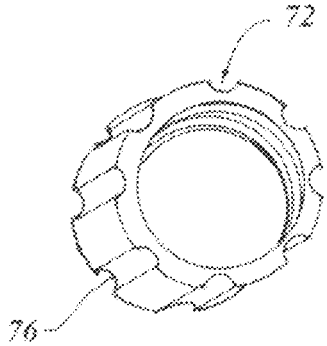
FIG. 16 is a partial isometric view of a forward recoil lug in a fluted configuration in both embodiments, completely removed from the invention for clarity.

A barrel lock nut 72 is attached to each set of forward lug attaching threads 36 that also engage the forward recoil lugs 48, assuring an unyielding junction therebetween. The barrel lock nut 72 also preferably has an exterior shape that matches the barrel 24 configuration which includes the same octagonal shape 74, illustrated in FIG. 15, a fluted shape 76, shown in FIG. 16, and a round outside diameter 78, depicted in FIG. 14 including a gripping hole 78[a] configured to receive a spanner.

The receiver recoil lug 38, the forward recoil lugs 48 and the barrel lock nut 72 are preferably formed from a material such as 410 stainless steel, 4140 chrome moly steel, or carbon fiber.

Figure 6:
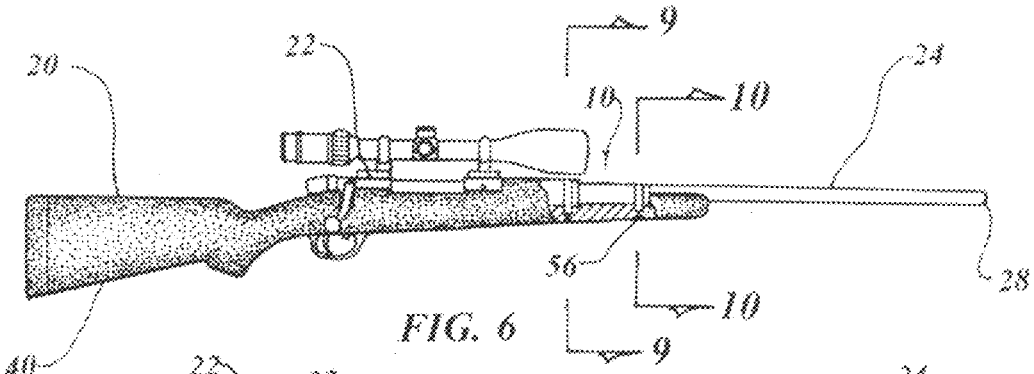
FIG. 6 is a partial isometric cut away view of a typical large bore hunting rifle having plurality of recoil lugs in the alternate embodiment.
Figure 7:
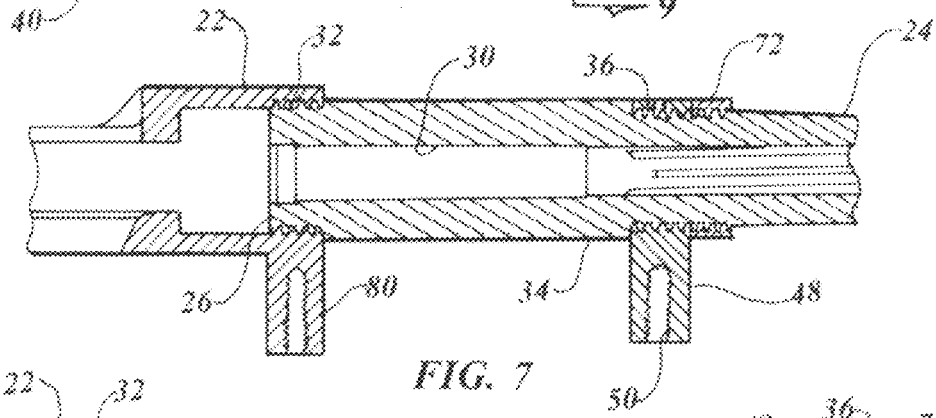
FIG. 7 is a partial cross sectional view taken along an imaginary centerline of a typical large bore hunting rifle with a threaded forward recoil lug installed at the distal end of the barrel extended chamber portion of the alternate embodiment.
Figure 8:
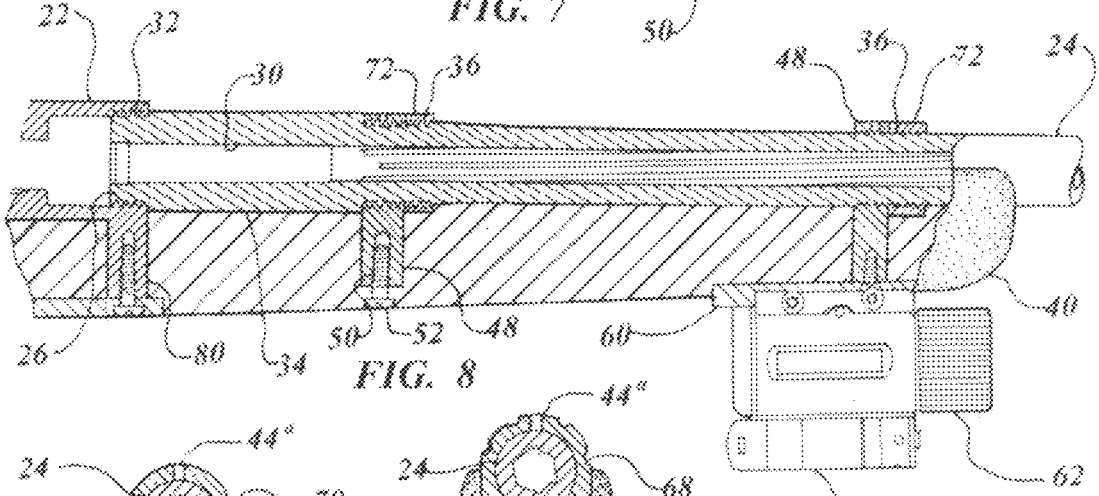
FIG. 8 is a partial cross sectional view taken along an imaginary centerline of a typical large bore hunting rifle with a first threaded forward recoil lug installed adjacent to the distal end of the barrel extended chamber portion and a second threaded forward recoil lug installed at least one inch from the rifle stock forend, with a forend rail having a flashlight/laser attached, in the alternate embodiment.

The alternate embodiment is illustrated in FIGS. 6 through 10, 11 and 13-16 with the only difference being that a rifle receiver 22 incorporates an integral receiver recoil lug 80, as shown in FIGS. 7 and 8, which entirely replaces the receiver recoil lug 38 of the preferred embodiment. Since the remaining components are completely identical each component is described using the same element designation.

The rifle barrel 24, in the alternate embodiment, is attached to the receiver 22. The barrel 24 has a receiver end 26 and a muzzle end 28 with at least one set of barrel forward lug attaching threads 36, located between the receiver end 26 and the muzzle end 28.

One or more threaded forward recoil lugs 48, in the alternate embodiment, are mated with the set of forward lug attaching threads 36 with each forward recoil lug 48 forming a forward recoil absorbing surface with the rifle stock 40, as depicted in FIGS. 6-10. Each forward recoil lug 48 includes a threaded hole 42[a] configured to mate with each set of forward lug attaching threads 36. While any number of forward recoil lugs 48 may be used they are preferably positioned on the barrel 24 no closer than 1.00 inch from a rifle stock 40 forend, as illustrated in FIG. 6.

The forward recoil lugs 48 each may include at least one supplementary mounting hole 44[a] on a top surface for attachment of sights or other ancillary items, with the mounting hole 44[a] threaded having the preferred thread characteristic from a #8-40 thread size to a #10-32 thread size. The forward recoil lug 48 also has a tapped bore 50 on a bottom surface preferably sized from a #10-32 thread size to a ⅜-24 thread size, or the like. Each bore 50 may be used for attachment of a forward recoil lug screw 52, depicted in FIG. 9, or ancillary accessories, which include a swing sling swivel 54, shown in FIG. 3, a detachable flush mount swivel 56, illustrated in FIG. 6, a bipod 58, depicted in FIG. 10, or a forend rail 60 permitting attachment of a flashlight 62 and/or laser 64 etc., shown in FIG. 8.

The exposed surface of the forward recoil lug 48 above the stock 40 preferably has an exterior shape that matches the barrel 22 configuration, which includes an octagonal shape 66, illustrated in FIG. 13, a fluted shape 68, shown in FIG. 10, and a round outside radius 70, depicted in FIG. 9.

A barrel lock nut 72 in the alternate embodiment is attached to each set of forward lug attaching threads 36, assuring an unyielding junction therebetween. The barrel lock nut 72 also preferably has an exterior shape that matches the barrel 22 configuration which includes an octagonal shape 74, illustrated in FIG. 15, a fluted shape 76 shown in FIG. 16, or a round outside diameter 78, depicted in FIG. 14 which includes a gripping hole configured to receive a spanner.

The forward recoil lugs 48 and the barrel lock nuts 72 are preferably formed from a material such as 410 stainless steel, 4140 chrome moly steel, or carbon fiber.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A plurality of recoil lugs for a rifle which comprises, a rifle receiver having an integral receiver recoil lug, a rifle barrel attached to the receiver with the barrel having a receiver end and a muzzle end with at least one set of barrel forward lug attaching threads located between the receiver end and the muzzle end wherein the barrel is directly adjacent to the receiver recoil lug, at least one threaded forward recoil lug mated with each at least one set of barrel forward lug attaching threads, forming at least one forward recoil absorbing surface with a rifle stock, and a barrel lock nut attached to at least one set of forward lug attaching threads contiguously engaging said at least one threaded forward recoil lug assuring an unyielding junction therebetween.

2. The plurality of recoil lugs for a rifle as recited in claim 1 wherein said at least one threaded forward recoil lug having a supplementary mounting hole with threads sized from a #8-40 thread size to a #10-32 thread size.

3. The plurality of recoil lugs for a rifle as recited in claim 1 and said at least one threaded forward recoil lug having a tapped bore on a bottom surface of from a #10-32 thread size to a ⅜-24 thread size.

4. The plurality of recoil lugs for a rifle as recited in claim 1 wherein said at least one threaded forward recoil lug and said barrel lock nut are formed from a material selected from the group consisting of 410 stainless steel, 4140 chrome moly steel, and carbon fiber.

5. The plurality of recoil lugs for a rifle as recited in claim 1 wherein said at least one threaded recoil lug having an accessory attached thereunto selected from the group consisting of a swing sling swivel, a detachable swivel, a flush mount swivel, a bipod, and a forend rail permitting attachment of a flashlight or laser.

6. The plurality of recoil lugs for a rifle as recited in claim 1 wherein said barrel lock nut further having an exterior shape selected from the group consisting of an octagonal shape, a fluted shape and a round outside diameter having a gripping hole on the outside diameter configured to receive a spanner.

* * * * *